US005847742A

United States Patent [19]

Nishimura

[11] Patent Number: 5,847,742

[45] **Date of Patent: *Dec. 8, 1998**

[54] COLOR THERMAL PRINTER AND COLOR THERMAL PRINTER METHOD

[75] Inventor: Tomoyoshi Nishimura, Saitama, Japan

[73] Assignee: Fuji Photo Film Co., Ltd., Kanagawa, Japan

[ * ] Notice: The term of this patent shall not extend beyond the expiration date of Pat. No. 5,711,620.

[21] Appl. No.: 747,401

[22] Filed: Nov. 12, 1996

[30] Foreign Application Priority Data

| | | | |
|---|---|---|---|
| Nov. 16, 1995 | [JP] | Japan | 7-298724 |
| Nov. 16, 1995 | [JP] | Japan | 7-298725 |
| Nov. 16, 1995 | [JP] | Japan | 7-298726 |
| Oct. 11, 1996 | [JP] | Japan | 8-270089 |

[51] Int. Cl.[6] ..... B41J 11/00

[52] U.S. Cl. ..... 347/173; 347/175; 347/218; 400/120.2

[58] Field of Search ..... 347/115, 116, 347/117, 172, 173, 174, 153, 157, 175, 215, 218; 400/120.2, 120.3, 120.4, 583.4

[56] References Cited

U.S. PATENT DOCUMENTS

| | | | |
|---|---|---|---|
| 4,996,541 | 2/1991 | Mori et al. | 346/108 |
| 5,386,772 | 2/1995 | Tolle et al. | 101/248 |
| 5,711,620 | 1/1998 | Sasaki et al. | 400/120.02 |
| 5,724,085 | 3/1998 | Inui et al. | 347/175 |

*Primary Examiner*—N. Lee
*Assistant Examiner*—Anh T. N. Vo
*Attorney, Agent, or Firm*—Birch, Stewart, Kolasch & Birch, LLP

[57] ABSTRACT

In a one-pass multi-head type color thermal printer having at least first to third printing stages arranged along a transport path, slacks are provided in the recording material between the first to third printing stages. The amounts of the slacks are measured by respective slack sensors. The transporting speed of the recording material through the second printing stage is fixed at a constant value, and the transporting speeds through the first and third printing stages are controlled in accordance with the outputs from the slack sensors, so as to maintain the amounts of the slacks constant. The slacks are provided during an initial loading of the recording material by delaying starting the transport of the recording material in downstream ones of the printing stages for a time after a leading edge of the recording material moves in each of the downstream printing stages until each of the slacks reaches a predetermined amount.

14 Claims, 15 Drawing Sheets

COLOR THERMAL PRINTER AND COLOR THERMAL PRINTER METHOD

BACKGROUND OF THE INVENTION

1. Field of the Invention

The present invention relates to a color thermal printer which has a plurality of thermal heads and platen rollers arranged along a one-way path of a recording material, and a color thermal printing method for the color thermal printer. More particularly, the present invention relates to a color thermal printer and a color thermal printing method which are effective to avoid occurrence of unexpected density variation in the printed image, such as stripes of irregularly high or low densities, and color registration errors, which both could be caused when load to the recording material varies while the recording material moves along the path.

2. Background Arts

There are various types color thermal printers, e.g. direct color thermal printers, thermal color ink transfer printers, and thermal color wax transfer printers. The direct color thermal printer uses a thermosensitive recording sheet which includes cyan, magenta and yellow recording layers having different heat sensitivities to develop respective colors in different heat energy ranges from one another.

There is a one-pass multi-head type color thermal printer which has a plurality of, e.g. three thermal heads, wherein a recording material is transported along a path by means of a plurality of pairs of feed rollers, and the thermal heads are disposed along the transport path. When a print area comes to an upstream one of the thermal heads, the thermal head is brought into contact with the recording material to start recording a color frame of a full-color image, e.g. a yellow frame. If it is the direct thermal printer, the yellow recording layer of the thermosensitive recording material, after having the yellow frame recorded thereto, is optically fixed by electromagnetic rays of a specific wavelength range projected from an optical fixing device. Thereafter when the print area comes to the next thermal head, e.g., the magenta recording head, the head is brought into contact with the recording material to start recording a magenta frame of the full-color image in the print area. In the direct thermal printer, the magenta recording layer after having the magenta frame recorded thereon is fixed by electromagnetic rays of a second specific wavelength range projected from a second optical fixing device. Likewise, the cyan recording head is brought into contact with the recording material to record a cyan frame of the full-color image in the print area.

The one-pass multi-head type has an advantage in that a shorter time is required for printing a full-color image compared with a three-pass one-head type color thermal printer which has one thermal head and in which a recording sheet passes three times under the single thermal head to record a full-color image. Moreover, because the spacings between the three color thermal heads may be determined as small as possible independently of the formats of images to be printed, the one-pass multi-head type can be compact.

However, in the one-pass three-head type, each time any of the thermal heads comes into contact with the recording material, the load applied to the recording material increases suddenly. The load to the recording material may change also depending upon the temperature of the recording material, namely, the heat energy applied from the thermal head. This is because the temperature of the recording material has effect on the friction between the recording material and the heating elements. The change in load can changes the transporting speed of the recording material.

Moreover, if the diameters of the capstan rollers differ from one another for example because of production tolerance, the transporting speed through each of the thermal heads would differ from one another even through the capstan rollers are rotated by a common pulse motor or at the same pulse repetition rate. In result of the change in transporting speed, the recording material would be tensed or loosen between two adjacent thermal heads. If the recording material is tensed, irregularly high or low density stripes or color registration errors could be provided in the printed images. Too loose recording material is apt to be jammed.

To avoid this problem, it may be possible to detect the change in transporting speed through each of the thermal heads, and control it to be constant. However, because the change of the transporting speed caused by the load change and thus the change in transporting speed are so slight, a highly accurate and thus expensive displacement gage such as a laser displacement gage is necessary for measuring the change, particularly when the recording material is transported as a continuous web. Therefore, this solution is not advantageous in view of practical use.

To speed the printing and to make the printer compact, it is preferable to make the spacings between the thermal heads as short as possible. However, if the shorter the spacings, the recording material is more likely to be tensed because of its stiffness, and is more likely to be affected by the change in load.

SUMMARY OF THE INVENTION

A prime object of the present invention is, therefore, to provide a color thermal printing method and a color thermal printer therefor which prevents unexpected density or color variation and color registration errors that could be caused by the change in load to the recording material during transportation.

To achieve the above object, in a one-pass multi-head type color thermal printer having at least first to third printing stages arranged along a transport path, slacks are provided in the recording material between the first to third printing stages by delaying starting the transport of the recording material in downstream ones of the printing stages for a time after a leading edge of the recording material moves in each of the downstream printing stages until each of the slacks reaches a predetermined amount. The amounts of slacks are measured by respective slack sensors. The transporting speed of the recording material through the second printing stage is fixed at a constant value, and the transporting speeds through the first and third printing stages are controlled in accordance with the outputs from the slack sensors, so as to maintain the amounts of the slacks constant.

According to a preferred embodiment, the slack sensors are micro-displacement gages which measure a distance to a peak of the corresponding slack.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
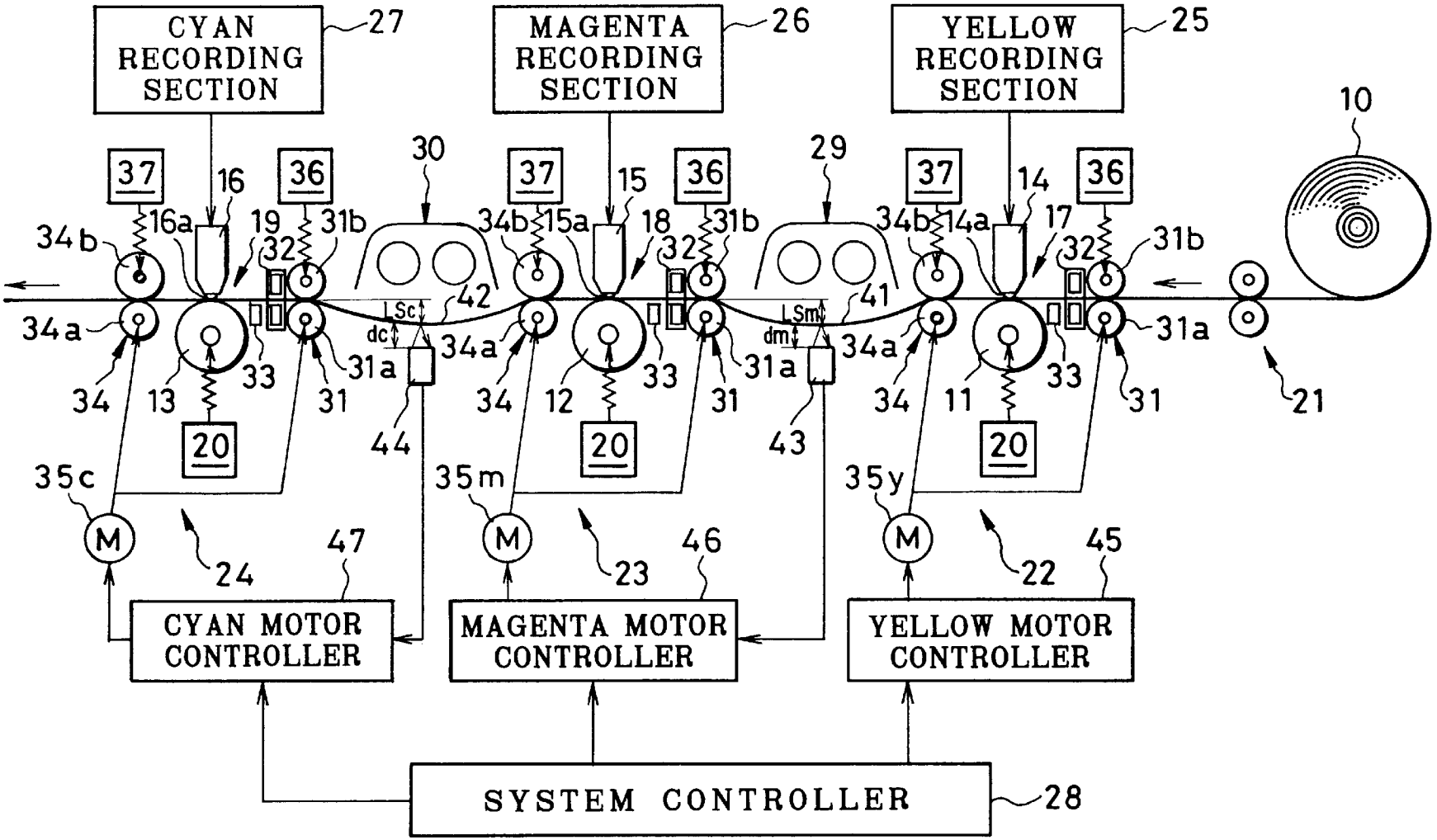
FIG. 1 is a schematic diagram illustrating a one-pass three-head type direct color thermal printer according to an embodiment of the present invention.

In the thermal printer of FIG. 1, three platen rollers 11, 12 and 13 are disposed at appropriate intervals along a transport path of a color thermosensitive recording material 10, hereinafter referred to as a recording material 10. In opposition to the platen rollers 11 to 13, a yellow thermal head 14, a magenta thermal head 15 and a cyan thermal head 16 are disposed to provide a yellow printing stage 17, a magenta printing stage 18 and a cyan printing stage 19, respectively. The platen rollers 11 to 13 are coupled to roller shifting mechanisms 20, which switch over the platen rollers 11 to 13 each individually between a pressing position pressed against heating elements 14*a*, 15*a* and 16*a* of the thermal heads 14 to 16, on one hand, and a retracted position away from the thermal heads 14 to 16. A paper supply mechanism 21 draws out the recording material 10 from a roll toward the yellow printing stage 17.

There are yellow, magenta and cyan transporting sections 22, 23 and 24 for transporting the recording material 10 through the respective printing stages 17 to 19, and yellow, magenta and cyan recording sections 25, 26 and 27 for driving the yellow, magenta and cyan thermal heads 14 to 16. These sections 22 to 27 are controlled by a system controller 28, to thermally record a full-color image on the recording material in a frame sequential fashion. An optical fixing device 29 for yellow is disposed between the yellow thermal head 14 and the magenta thermal head 15. The optical fixing device 29 radiates ultraviolet rays having an emission peak at 420 nm, to fix the yellow recording layer of the recording material 10 after having a yellow frame recorded thereto. An optical fixing device 30 for magenta is disposed between the magenta thermal head 15 and the cyan thermal head 16. The optical fixing device 30 radiates near-ultraviolet rays having an emission peak at 365 nm, to fix the magenta recording layer of the recording material 10 after having a magenta frame recorded thereto.

Each of the transporting sections 22 to 24 is constituted of a subsidiary feed roller pair 31 and a main feed roller pair 34, which are disposed before and behind each of the platen rollers 11 to 13 with respect to a transporting direction of the recording material 10, respectively. Behind the respective subsidiary feed roller pairs 31 in the transporting direction, leading edge sensors 32 and mark sensors 33 are disposed. Each feed roller pair consists of a capstan roller 31*a* or 34*a* and a pinch roller 31*b* or 34*b*. The capstan rollers 31*a* and 34*a* are driven by pulse motors 35*y*, 35*m* and 35*c*. Roller shifting mechanisms 36 and 37 are coupled to the pinch rollers 31*b* and 34*b* to move them each individually between a feeding position pressed onto the capstan rollers 31*a* and 34*a*, and a retracted position away from the capstan rollers 31*a* and 34*a*, respectively. The pressure of the pinch rollers 31*b*, i.e. the nipping power of the subsidiary feed roller pairs 31 is set smaller than that of the main feed roller pairs 34, so that the recording material 10 is transported mainly by the power of the feed roller pairs 34.

The leading edge sensors 32 detect the leading edge of the recording material 10, and each outputs a leading edge detection signal to the system controller 28, though the connections are omitted from the drawings for clarity sake. The mark sensors 33 detect marks provided on the recording material 10 at regular intervals, and output a mark detection signal at each detection of the marks. The system controller 28 tracks the position of the leading edge based on the leading edge detection signal and the number of drive pulses applied to the pulse motor 35*y*, 35*m* or 35*c* in each printing stage 17, 18 and 19, and controls the roller shifting mechanisms 36 and 37 for the feed roller pairs 31 and 34. The system controller 28 also determines based on the mark detection signal and the number of drive pulses when to press the recording material 10 onto the thermal head 14, 15 or 16, and when to start recording a color frame in each printing stage, and controls the roller shifting mechanisms 20 for the platen rollers 11 to 13 and the recording sections 25 to 27.

The recording material 10 is provided with slacks 41 and 42 between the respective printing stages 17 to 19. The amounts or magnitudes LSm and LSc of the slacks 41 and 42 are measured by slack sensors 43 and 44, respectively. The slack sensors 43 and 44 are micro-displacement gages and are disposed under middle portions of the slacks 41 and 42, to measure a distance "dm" or "dc" to the lowermost portion of each slack 41 or 42, i.e. the most sagging surface of the recording material 10, as being representative of the slack amount LSm or LSc of each slack 41 or 42, respectively.

Figure 2:
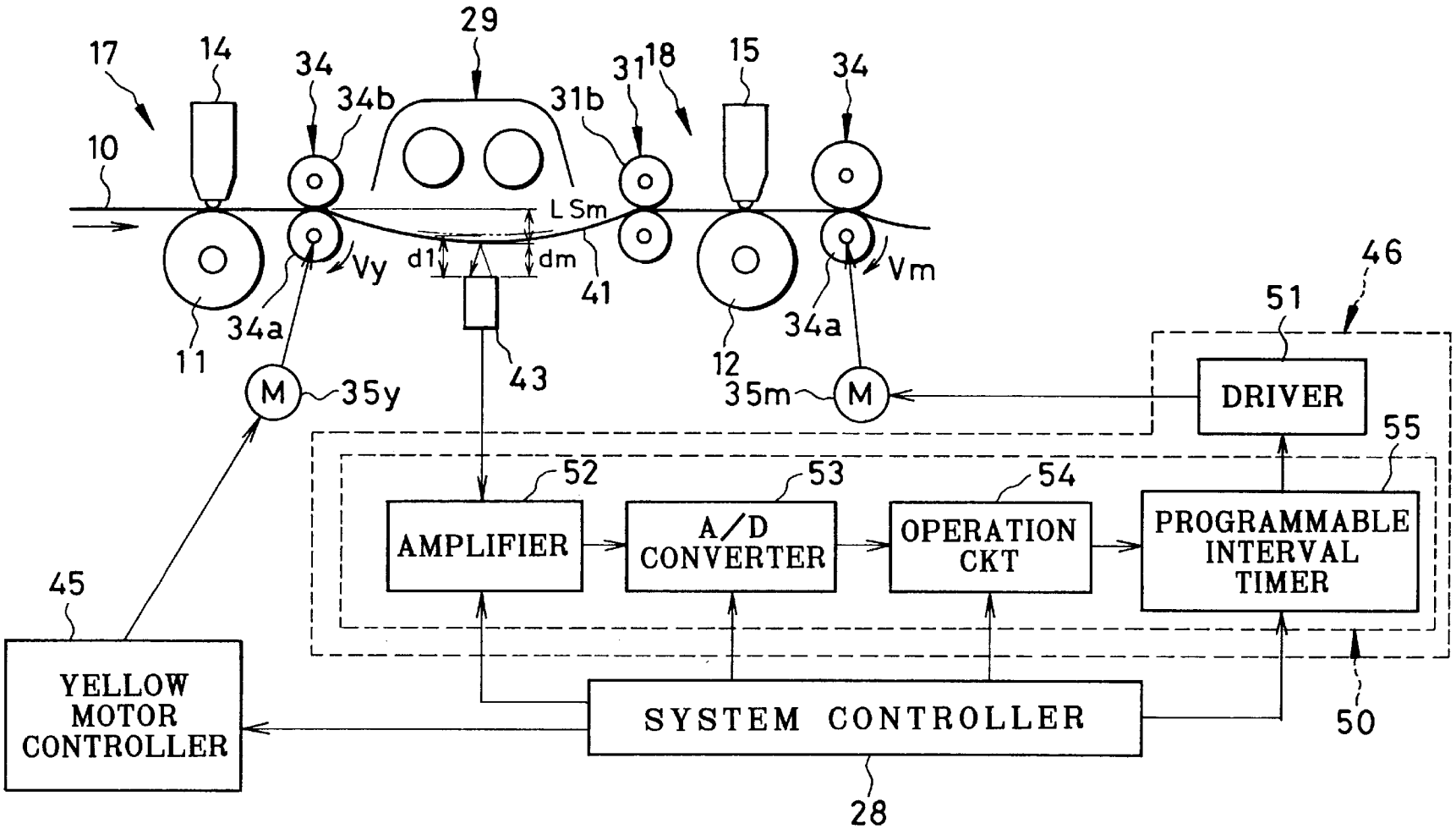
FIG. 2 is an enlarged explanatory view illustrating a magenta motor controller which operates with reference to the amount of a slack of the recording material between yellow and magenta printing stages of the thermal printer of FIG. 1.

The pulse motors 35*y*, 35*m* and 35*c* of the transporting sections 22 to 24 are controlled through yellow, magenta and cyan motor controllers 45, 46 and 47, respectively. The yellow motor controller 45 outputs drive pulses to the pulse motor 35*y* through an incorporated driver. The distance signals dm and dc from the slack sensors 43 and 44 are sent to the magenta motor controller 46 and the cyan motor controller 47, respectively. The magenta motor controller 46 is constituted of a slack controller 50 and a driver 51, as shown in FIG. 2. The slack controller 50 receives the distance signal dm, and controls the driver 51 to output drive pulses to the pulse motor 35*m* at a variable pulse repetition rate so as to change the rotational speed of the pulse motor 35*m* in accordance with the amount LSm of the slack 41, as set forth in detail below.

In the slack controller 50, an amplifier 52 amplifies the distance signal dm from the slack sensor 43 up to a voltage level suitable for an A/D converter 53. The A/D converter 53 converts the distance signal dm into a digital form and sends it to an operation circuit 54. The operation circuit 54 averages the distance signals dm and corrects non-linearity, and calculates a distance value dm according to a predetermined formula. The operation circuit 54 then compares the distance value dm with a distance value d1 that represents a reference slack amount. In accordance with the result of comparison, the operation circuit 54 determines a pulse repetition rate of drive pulses to the pulse motor 35*m* of the magenta transporting section 23. A setup value or load value for the pulse repetition rate is sent to a programmable interval timer 55. The programmable interval timer 55 counts reference clocks up to the setup value. Each time the count reaches the setup value, the programmable interval timer 55 inverts its output level, i.e. the drive pulse signal to the pulse motor 35*m*, and starts counting from zero. In this way, drive pulses having a duty factor of 50% are generated at the pulse repetition rate determined by the operation circuit 54.

The cyan motor controller 47 has the same construction as the magenta motor controller 46, and operates with reference to the distance signal dc from the slack sensor 44, in the same way as the magenta motor controller 46.

Figure 3:
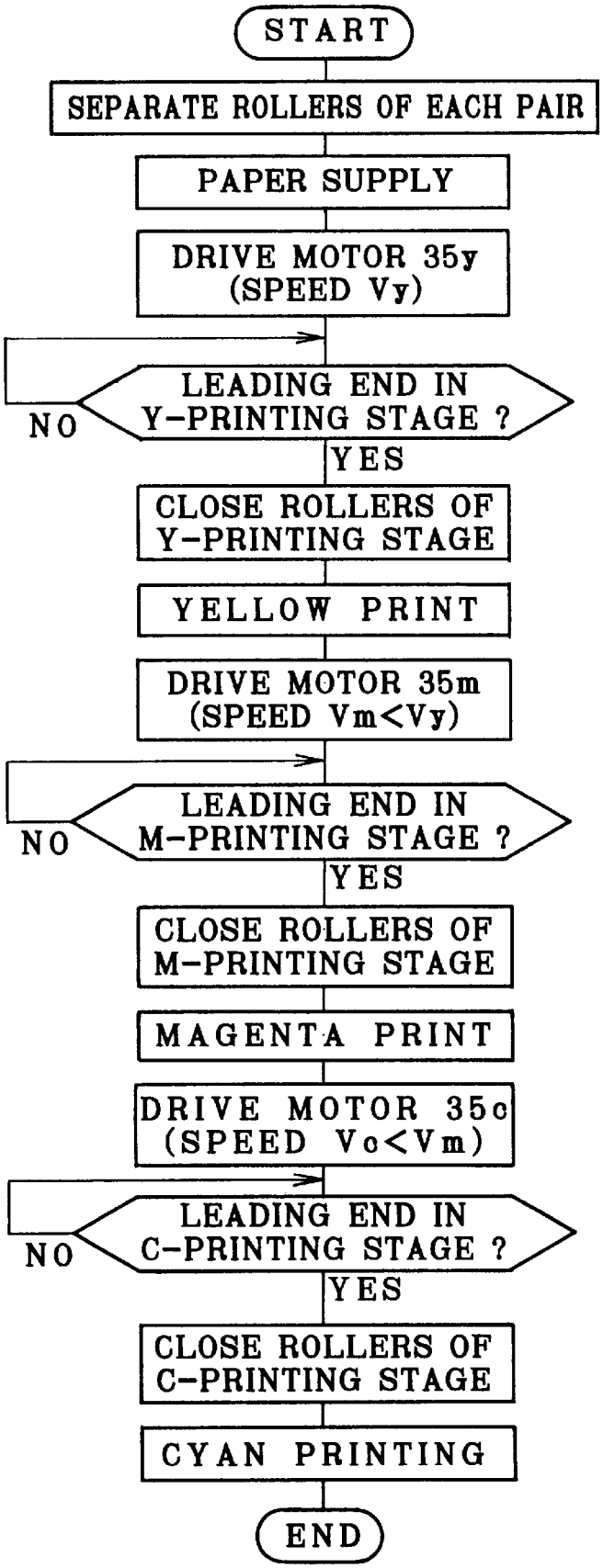
FIG. 3 is a flow chart illustrating a sequence of providing slacks in the recording material between the respective thermal heads in the thermal printer of FIG. 1, according to a first method of the invention.

As shown in FIG. 3, the slacks 41 and 42 are provided during an initial loading of the recording material 10 in the thermal printer by differentiating transporting speeds Vy, Vm and Vc of a leading portion of the recording material 10 through the printing stages 17 to 19 from one another. On the initial loading, first the roller shifting mechanisms 36, 37 and 20 are actuated to separate the pinch rollers 31*b* and 34*b* from the capstan rollers 31*a* and 34*a*, and the platen rollers 11 to 13 from the thermal heads 14 to 16. Simultaneously, the optical fixing devices 29 and 30 are turned on. Then, the paper supply mechanism 21 starts supplying the recording material 10 toward the yellow printing stage 17. The pulse motor 35*y* starts being driven at a predetermined pulse repetition rate, to rotate the capstan rollers 31*a* and 34*a* of the yellow transporting section 22 at a constant peripheral speed Vy, i.e. a constant transporting speed Vy through the yellow printing stage 17.

When it is determined based on the signal from the leading edge sensor 32 that the leading edge of the recording material 10 has passed through the subsidiary feed roller pair 31, the rollers 31*a* and 31*b* are closed to nip the leading portion of the recording material 10. In the same way, the rollers 34*a* and 34*b* of the main feed roller pair 34 are closed to nip the recording material 10. With reference to the mark detection signal from the mark sensor 33, a leading end of an initial print area of the recording area is determined, and the platen roller 11 is moved to press the recording material 10 onto the yellow thermal head 14, to start recording a first yellow frame line by line from the leading end of the print area.

Then, the pulse motor 35*m* starts being driven at a lower pulse repetition rate than that of the pulse motor 35*y*. That is, a transporting speed Vm through the magenta printing stage 18 is set lower than the transporting speed Vy through the yellow printing stage 17 during the initial loading. With reference to the signal from the leading edge sensor 32 in the magenta printing stage 18, the rollers 31*a* and 31*b*; 34*a* and 34*b* of the feed roller pairs 31 and 34 are closed to nip the recording material 10 respectively when the leading edge of the recording material 10 goes past the feed roller pairs 31 and 34. With reference to the mark detection signal from the mark sensor 33, the platen roller 12 is moved to press the recording material 10 onto the magenta thermal head 15, and the magenta recording section 26 starts driving the magenta thermal head 15 to record a first magenta frame line by line in the initial print area.

The pulse motor 35*c* is driven at a lower pulse repetition rate than the pulse motor 35*m*, so that a transporting speed Vc through the cyan printing stage 19 is set lower than the transporting speed Vm through the magenta printing stage 18 during the initial loading. Also in the cyan printing stage 19, the roller shifting mechanisms 36 and 37 are actuated with reference to the signal from the leading edge sensor 32, whereas the roller shifting mechanism 20 for the platen roller 13 and the cyan recording section 27 are actuated with reference to the mark detection signals to start recording a first cyan frame in the initial print area. In this way, a full-color image is printed in a frame sequential fashion in each print area. The recording material 10, after having the full-color image printed thereon, is transported to a not-shown ejection stage.

Due to the differences between the transporting speeds Vy, Vm and Vc (Vy>Vm>Vc) through the respective printing stages 17 to 19, the slacks 41 and 42 are provided in the recording material 10 between the respective printing stages 17 to 19. According to the present embodiment, the initial pulse repetition rates of the pulse motors 35*y*, 35*m* and 35*c* during the initial loading are defined such that the amount of each slack 41 or 42 reaches the reference amount represented by the value d1 when the initial print area has passed out the heating elements of the corresponding printing stage 18 or 19, respectively. For instance, when the first magenta frame has completely been recorded, the amount LSm of the slack 41 reaches the reference amount, so that the distance dm comes equal to the value d1. Therefore, immediately after the distance dm goes below the value d1, the pulse repetition rate to the pulse motor 35*m* of the magenta transporting section 23 is reset to the standard level, so that the transporting speed Vm through the magenta printing stage 18 is set equal to the transporting speed Vy through the yellow printing stage 17, to maintain the slack amount LSm in the reference value.

Figure 4:
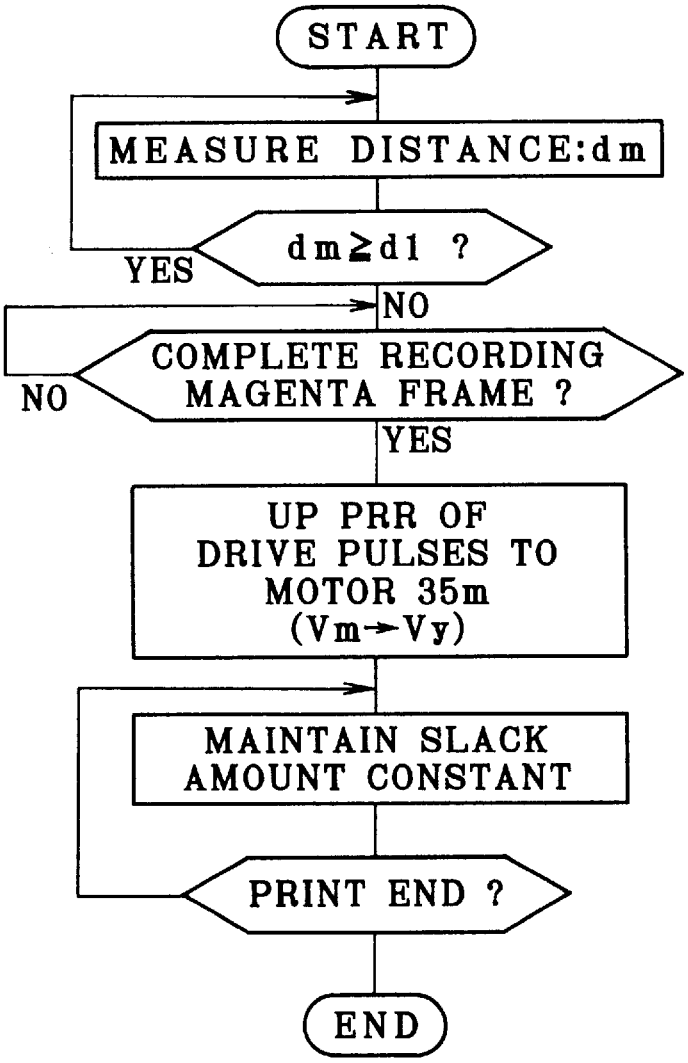
FIG. 4 is a flow chart illustrating an operation sequence of the magenta motor controller following the sequence of FIG. 3.

In the same way, after the amount LSc of the slack 42 reaches the reference value (dc=d1), i.e., immediately after the first cyan frame has completely been recorded, the transporting speed Vc through the cyan printing stage 19 is set equal to the transporting speed Vy. Because the transporting speeds Vm and Vc are changed while no recording is carried out in the associated printing stage, the speed change does not affect the recording. In the embodiment shown in FIG. 4, if the recording of the first frame is actually complete is checked before changing the pulse repetition rate, in order to make sure not to change the transporting speed until the recording of one frame is finished. However, it is possible to change the transporting speed simply when the slack amount reaches the reference value.

It is alternatively possible to design that the respective slacks 41 and 42 reach the reference amount in response to a transporting amount corresponding to several frames. It is also possible to predetermine the initial pulse repetition rates of the pulse motors 35*y*, 35*m* and 35*c* such that the amount LSm of the slack 41 reaches the reference amount immediately before the leading end of the initial print area comes under the magenta thermal head 15, and the amount LSc of the slack 42 reaches the reference amount immediately before the leading end of the initial print area comes under the cyan thermal head 16. According to this embodiment, the transporting speeds Vm and Vc are changed to be equal to the transporting speed Vy in those periods when a leading margin from the leading edge of the recording material to the leading end of the initial print area is transported under the thermal heads 15 and 16, respectively. Therefore, the recording material 10 is transported at the same speed through the respective printing stages.

Figure 5:
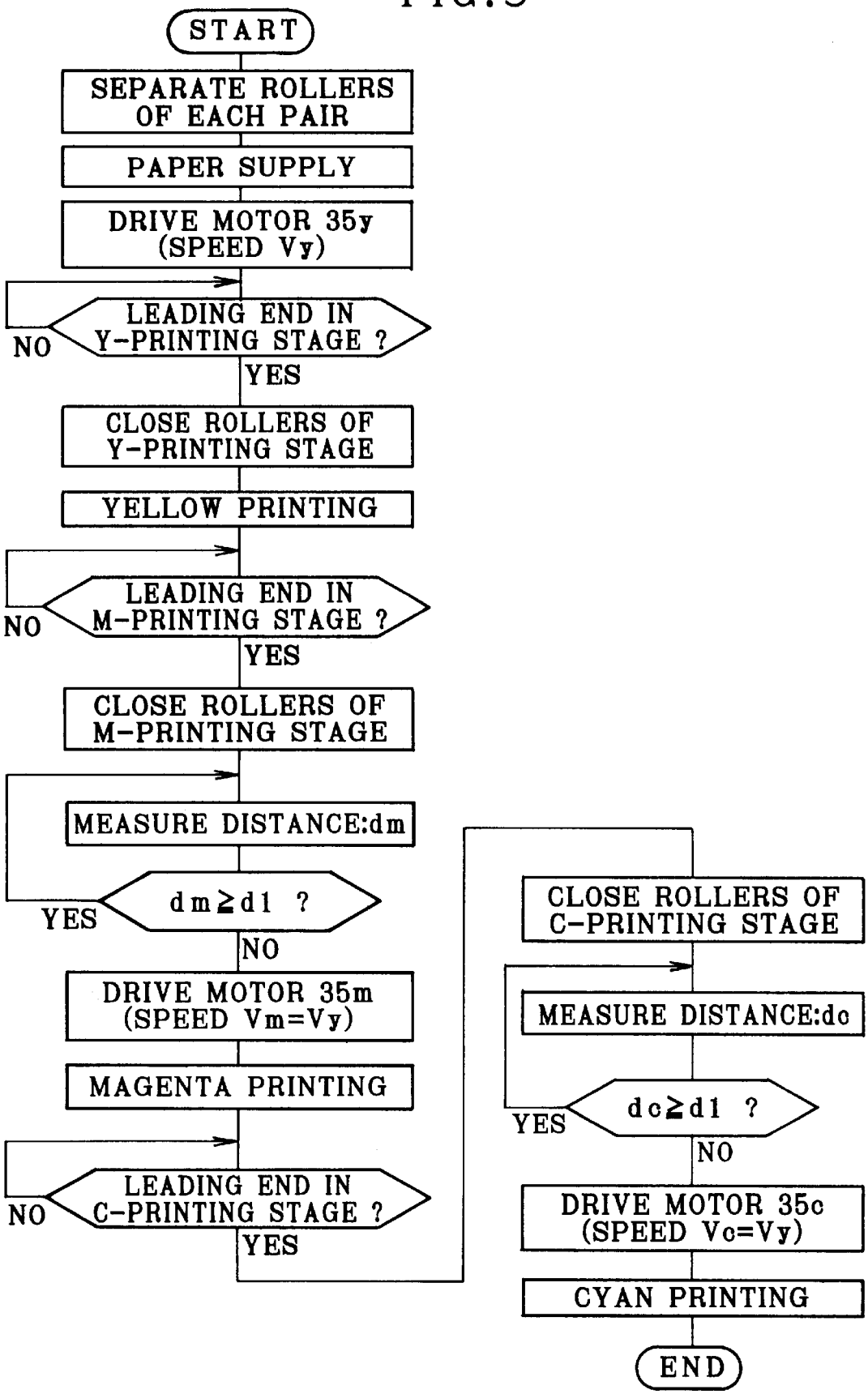
FIG. 5 is a flow chart illustrating a sequence of forming slacks in the recording material between the thermal heads of the thermal printer of FIG. 1, according to a second method of the invention.

In place of forming the slacks 41 and 42 by differentiating the transporting speeds Vy, Vm and Vc from one another during the initial loading of the recording material 10, it is possible to form the slacks 41 and 42 by delaying the start of rotating the feed roller pairs 31 and 34 for a time from the time of nipping the recording material 10 in the magenta and cyan printing stages, as illustrated in FIG. 5. For instance, the feed roller pairs 31 and 34 of the magenta transporting section 23 are not rotated for a while after nipping the leading portion of the recording material 10. When the amount LSm of the slack 41 reaches the reference value (dm=d1), then the pulse motor 35*m* starts to be driven at the same pulse repetition rate as the pulse motor 35*y*, to transport the recording material 10 through the magenta printing stage 18 at the same speed as the yellow printing stage 17. The second slack 42 is formed in the same way as the slack 41.

After the slacks 41 and 42 are formed to have the reference amount, the magenta motor controller 46 and the cyan motor controller 47 operate to maintain the slack amounts LSm and LSc in a range around the reference slack amount by changing the pulse repetition rate (PRR) relative to a standard pulse repetition rate. In the magenta motor controller 46, for example, the operation circuit 54 compares the distance value dm from the slack sensor 43 with the reference distance value d1. In accordance with the result of comparison, the operation circuit 54 determines a pulse repetition rate necessary for approaching the slack amount LSm to the reference slack amount, and outputs a setup or load value for the pulse repetition rate to the programmable interval timer 55. The programmable interval timer 55 counts reference clocks up to the setup value to invert its output level each time the count reaches the setup value, and starts counting from zero. In this way, drive pulses having the pulse repetition rate determined by the operation circuit 54 are applied to the pulse motor 35*m* of the magenta transporting section 23.

Figure 6:
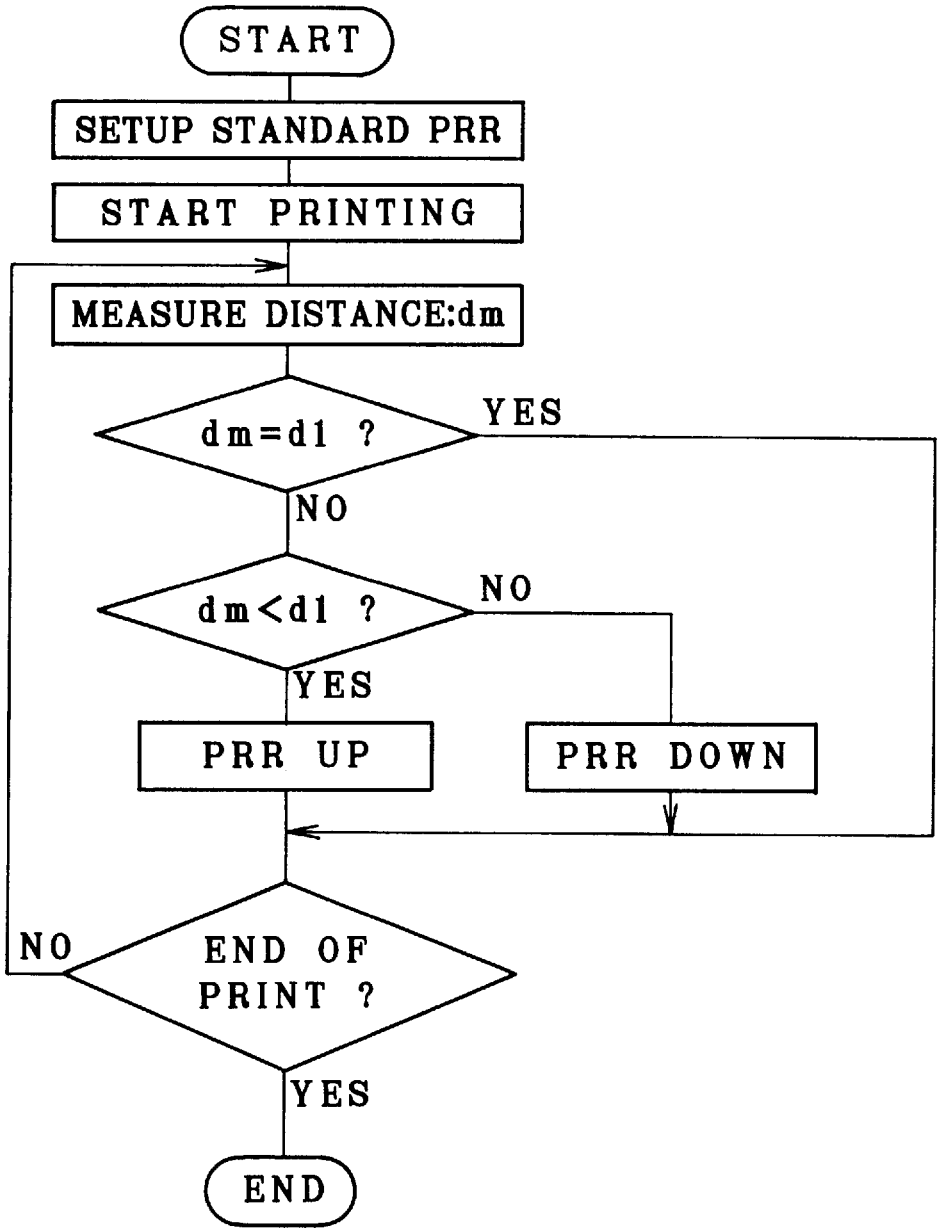
FIG. 6 is a flow chart illustrating an operation sequence of the magenta motor controller to maintain the slack amount between the yellow and magenta thermal heads constant.

For example, as shown in FIG. 6, when the slack amount LSm becomes more than the reference amount, i.e. dm<d1, the pulse repetition rate is set higher than the standard level or the present level. Then, the transporting speed Vm through the magenta printing stage 18 increases to reduce the slack amount LSm to the reference amount. If the slack amount LSm becomes less than the reference amount, i.e. dm>d1, the pulse repetition rate is set lower than the standard level or the present level to decelerate the transporting speed Vm. Thus, the slack amount LSm is added up to the reference amount.

Figure 7:
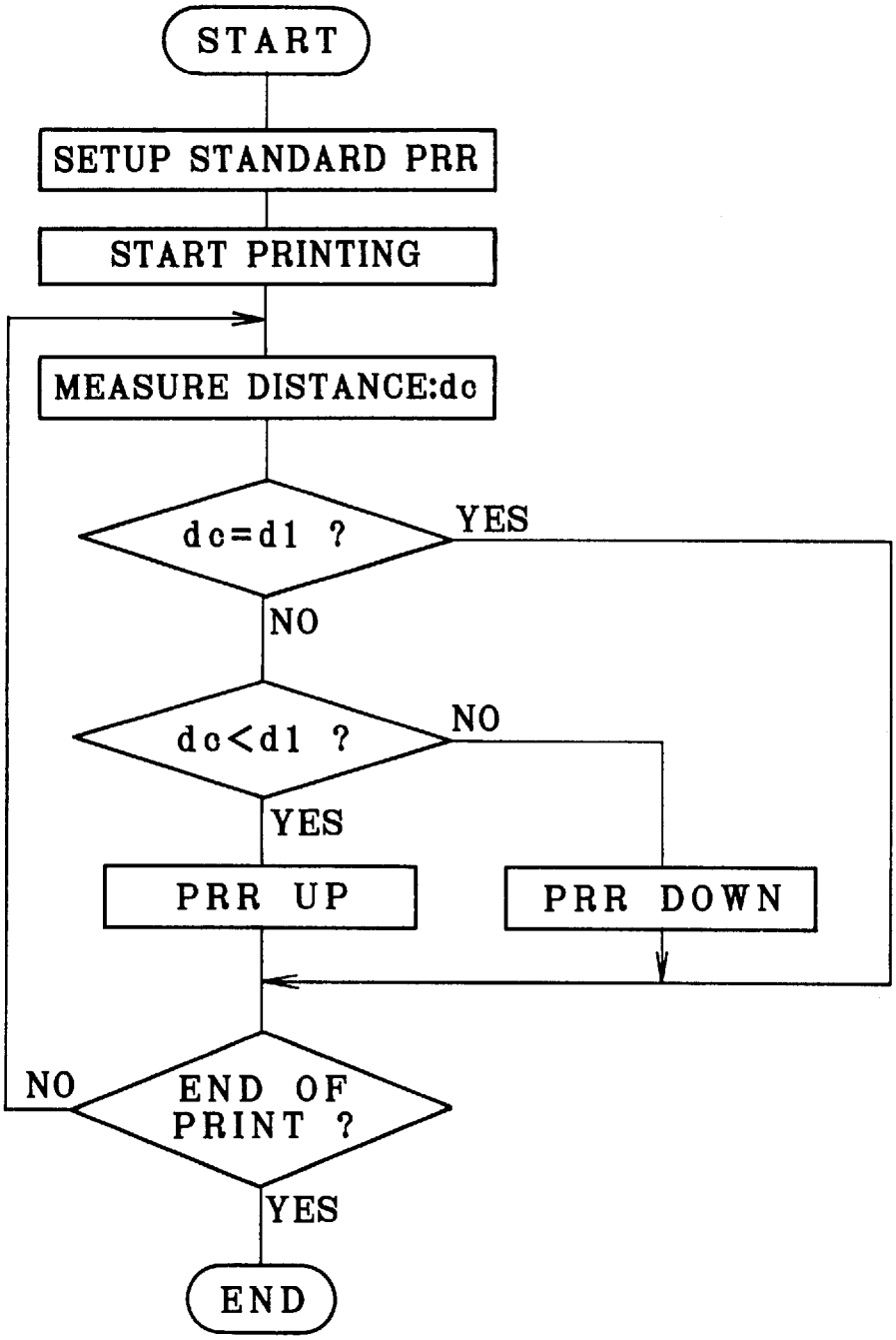
FIG. 7 is a flow chart illustrating an operation sequence of a cyan motor controller to maintain the amount of a slack of the recording material between the magenta thermal heads constant.

Also, the cyan motor controller 47 raises the pulse repetition rate of the pulse motor 35*c* when the slack amount LSc becomes more than the reference amount (dc<d1), and lowers the pulse repetition rate when the slack amount LSc becomes less than the reference amount (dc>d1), as shown in FIG. 7. At that time, since the pulse repetition rate of the pulse motor 35*y* of the yellow or most upstream printing stage 17 is maintained to be the standard value, while the pulse repetition rates of the pulse through the following printing stages 18 and 19 are changed with reference to the standard pulse repetition rate, the pulse repetition rate of the pulse motor 35*c* should be controlled based not only on a deviation of the distance value dc from the reference value d1 but also a deviation of the distance value dm from the reference value d1.

Figure 8:
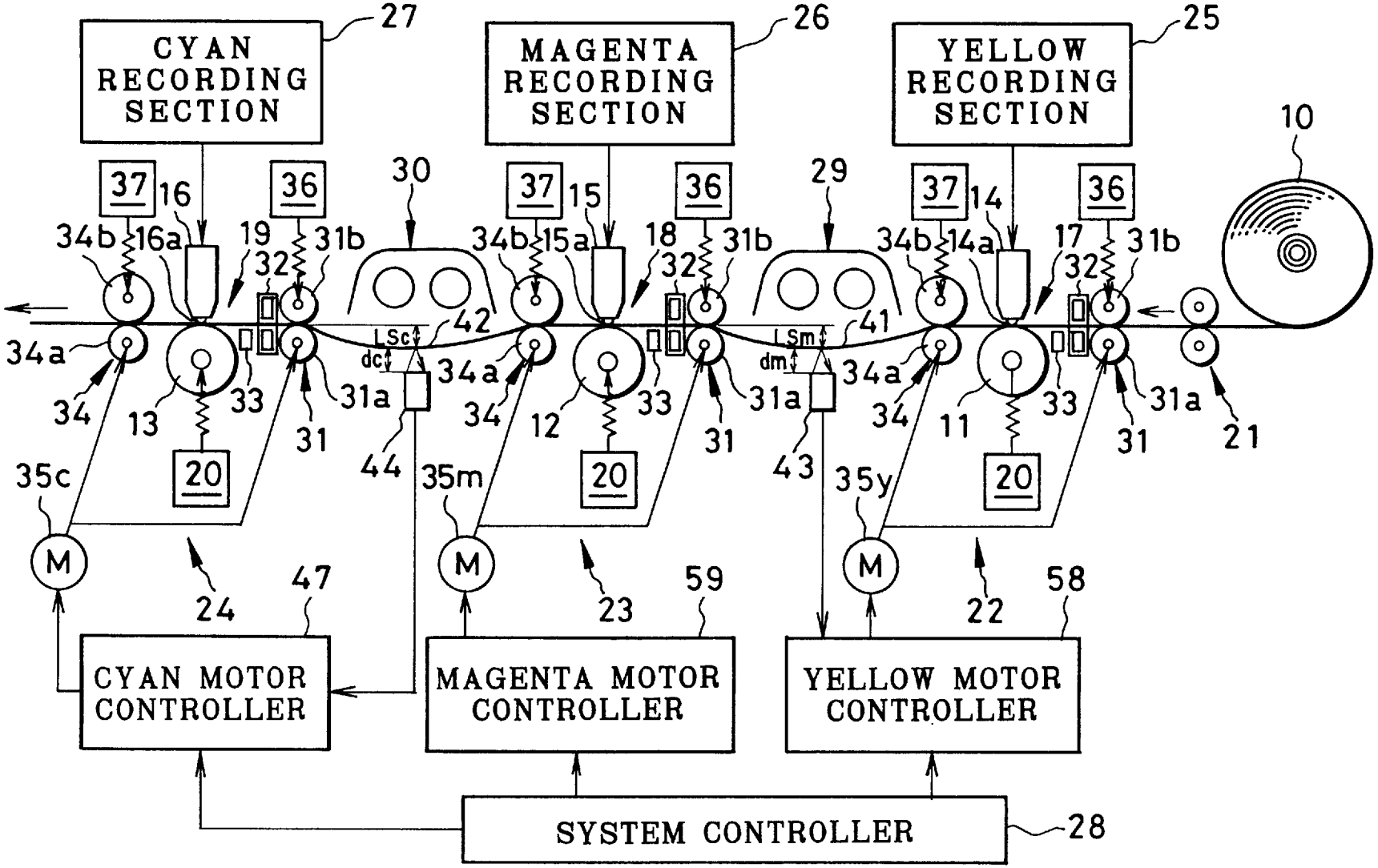
FIG. 8 is a schematic diagram illustrating a one-pass three-heads type direct color thermal printer according to another embodiment of the invention, wherein drive pulses from a magenta motor controller maintain a constant pulse repetition rate.

Alternatively, it is possible to maintain the transporting speed Vm through the second upstream printing stage 18 constant, and change the transporting speeds Vy and Vc through other printing stage 17 and 19 with reference to the constant speed, as is shown in FIG. 8. In this embodiment, the output of a slack sensor 43 is connected to a yellow motor controller 58 having the same construction as the magenta motor controller 46 of the first embodiment shown in FIG. 2. On the other hand, a magenta motor controller 59 does not receive the distance signal dm from the slack sensor 43, and generates drive pulses at a constant pulse repetition rate.

Figure 9:
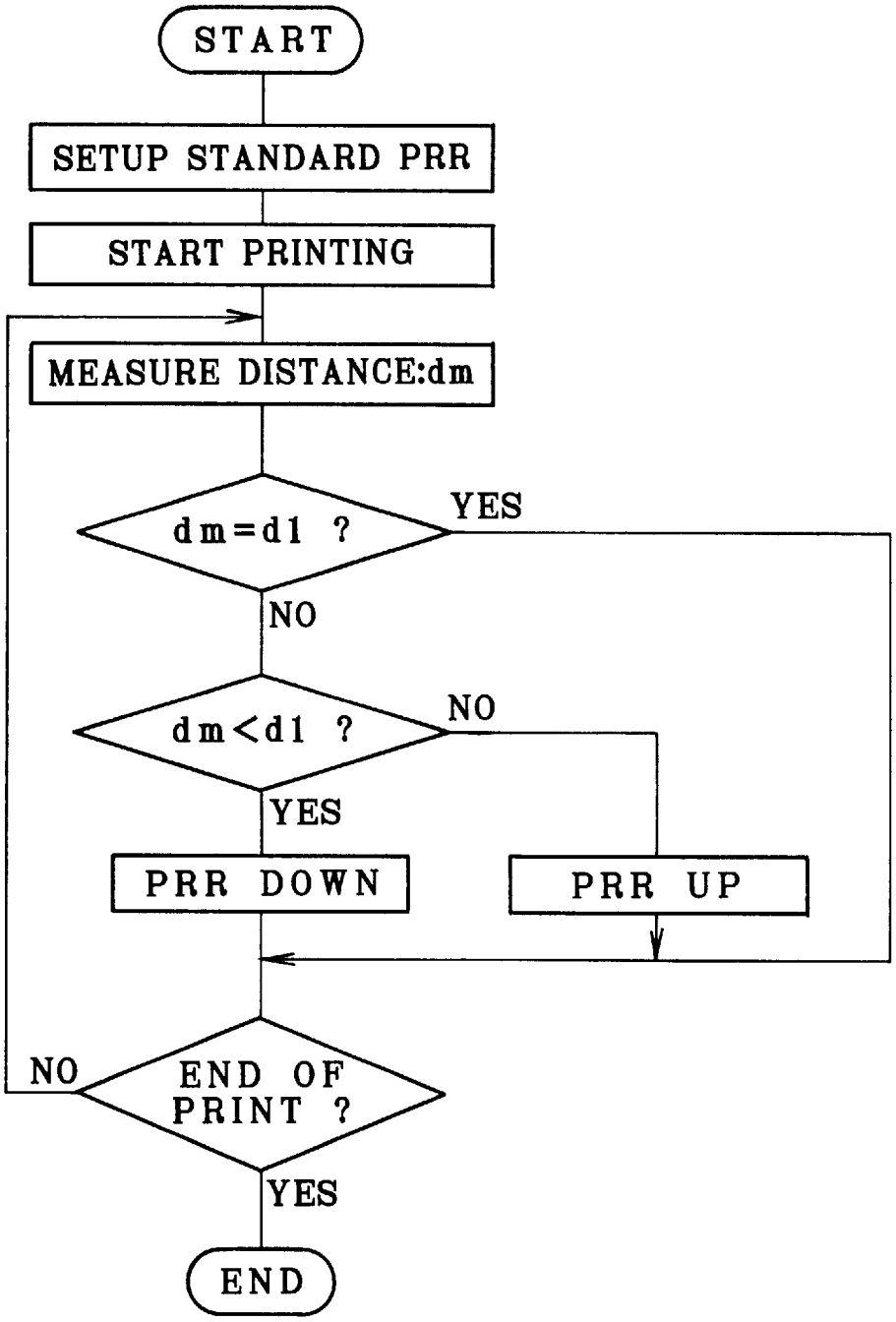
FIG. 9 is a flow chart illustrating an operation sequence of a yellow motor controller of the thermal printer of FIG. 8.

The yellow motor controller 58 operates in the opposite direction to the magenta motor controller 46 of the first embodiment, because the yellow motor controller 58 controls the amount of the slack 41 behind the yellow printing stage 17. That is, the yellow motor controller 58 lowers the pulse repetition rate of the pulse motor 35*y* when the amount LSm of the slack 41 becomes more than the reference amount (dm<d1), and raises the pulse repetition rate when the slack amount LSm becomes less than the reference amount (dm>d1), as shown in FIG. 9. In this way, the transporting speed Vy through the yellow printing stage 17 is lowered to reduce the slack amount LSm, or is raised to add up the slack amount LSm.

In this embodiment, a cyan motor controller 47 has the same construction and operates in the same direction as the first embodiment, but the pulse repetition rate of the pulse motor 35*c* is determined based on the slack amount LSc alone. Other elements may be equal to those designated by the same reference numbers in FIG. 1.

It is also possible to fix the cyan transporting section 24 at the standard pulse repetition rate, though it is not shown in the drawings. In that case, the output of the second slack sensor 44 is connected to a magenta motor controller which operates in the same direction as the yellow motor controller 58 of the embodiment of FIG. 8.

In the slack amount maintaining operation as above, it is preferable to change the pulse repetition rate while a margin between two adjacent print areas passes through the heating elements of the associated printing stage, so that the speed change may not affect the recording. However, as described above, there may be a slight difference in transporting speed between the printing stages that is caused, for example, by a slight difference in diameter or periphery between the capstan rollers 34*a* of the main feed roller pairs 34, which can be provided because of production tolerance. If the diameters of the capstan rollers differ from one another, the transporting speed through each of the thermal heads would differ from one another even through the capstan rollers are driven at the same pulse repetition rate.

For example, if the transporting speed Vy of the yellow transporting section 22 is slightly higher than the transporting speed Vm of the magenta transporting section 23 at the same pulse repetition rate, the amount LSm of the slack 41 would increase. Therefore, in order to correct the difference of transporting speeds Vy and Vm, it is preferable to change the pulse repetition rate of one of the two adjacent transporting sections 22 and 23 relative to the other, such that the slack amount LSm is always maintained to be the reference amount. As a result, the transporting speeds Vy and Vm are corrected to be practically equal to each other in spite of any size variation of the capstan rollers. Therefore, color registration errors are reduced to the minimum. The same applies to a difference in transporting speeds Vm and Vc due to the difference between the capstan rollers 34*a* of the magenta and the cyan transporting sections 23 and 24, or the like.

To improve the accuracy of slack maintaining operation, it is effective to detect the slack amounts LSm and LSc more frequently, to change the pulse repetition rate more frequently. For this purpose, the embodiment as shown in FIG. 8 is preferable, wherein the magenta transporting section 23 is maintained at the standard pulse repetition rate, i.e., the transporting speed through the middle printing stage is used as a reference value. In the thermal printer as shown in FIG. 1, the pulse repetition rate of the pulse motor 35*c* should be determined based not only on a deviation of the distance value dc from the reference value d1 but also a deviation of the distance value dm from the reference value d1.

Figure 10:
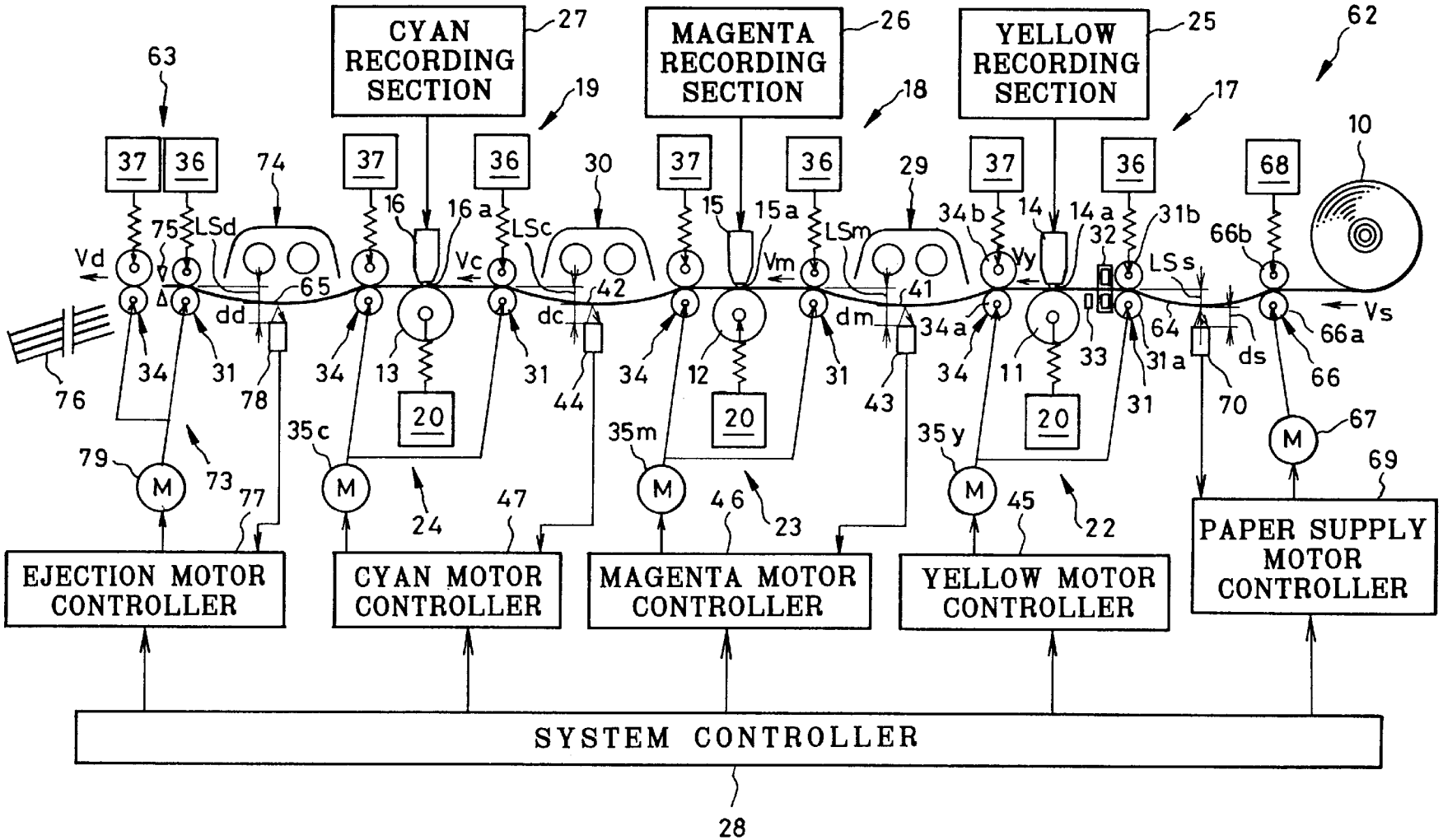
FIG. 10 is a schematic diagram illustrating a one-pass three-head type direct color thermal printer according to a third embodiment of the invention, wherein the recording material is provided with slacks before and behind the respective thermal heads.

FIG. 10 shows another embodiment wherein a recording material 10 is provided with slacks 64 and 65 before a yellow printing stage 17 and behind a cyan printing stage 19, in addition to slacks 41 and 42 between the respective printing stages 17 to 19. The printing stages 17 to 19 have the same construction as shown in FIG. 1, wherein the transporting speed Vy through the yellow printing stage 17 is maintained constant independently of the amount of any slacks 41, 42, 64 and 65.

A paper supply mechanism 62 has a pair of paper supply rollers 66 to supply the recording material 10 from a roll toward the yellow printing stage 17. A capstan roller 66*a* of the paper supply roller pair 66 is driven by a pulse motor or paper supply motor 67. A pinch roller 66*b* of the paper supply roller pair 66 is switched over by a roller shift mechanism 68 between a nipping position and a retracted position. The amount LSs of the slack 64 is measured by a slack sensor 70. The slack sensor is disposed under a middle portion the slack 64, to measure a distance "ds" to the most sagging surface of the recording material 10, as being representative of the slack amount LSs.

Figure 11:
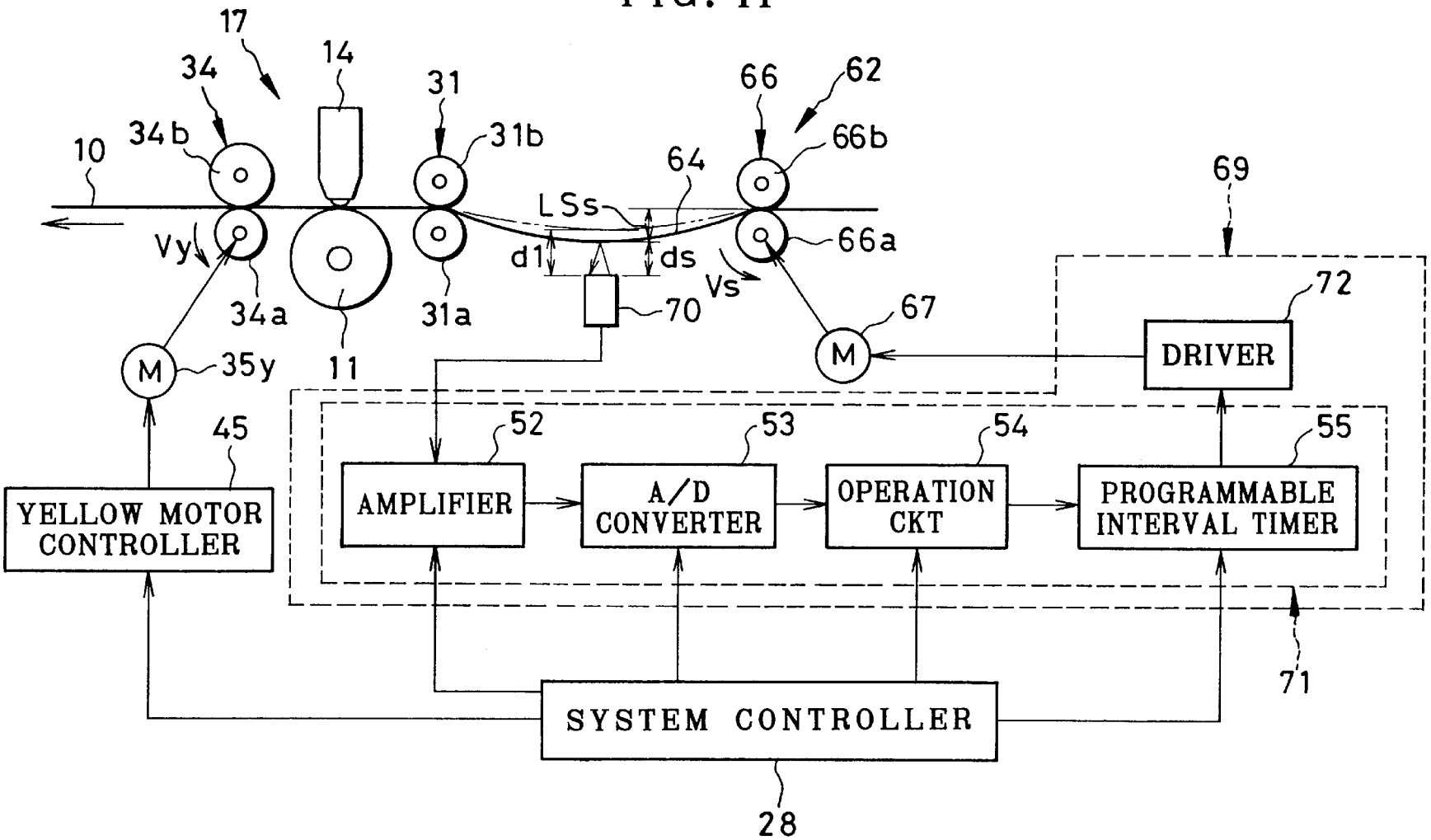
FIG. 11 is an enlarged explanatory view illustrating a paper supply motor controller which operates with reference to the amount of a slack before the yellow thermal head FIG. 10.

The drive of the paper supply motor 67 is controlled by a paper supply motor controller 69. As shown in FIG. 11, the paper supply motor controller 69 is constituted of a slack controller 71 and a driver 72, as shown in FIG. 11. The slack controller 71 receives a distance signal ds from the slack sensor 70, and controls the driver 72 to output drive pulses to the paper supply motor 67 at a variable pulse repetition rate so as to change the rotational speed of the motor 67, and thus the paper supply speed Vs in accordance with the amount LSs of the slack 64 between the paper supply mechanism 62 and the yellow printing stage 17.

The slack controller 71 has the same construction as the slack controller 50 as shown in FIG. 2, and operates in the same direction as the yellow motor controller 58 of the embodiment shown in FIGS. 8 and 9. That is, the paper supply motor controller 69 lowers the pulse repetition rate of the paper supply motor 35*s* when the amount LSs of the slack 64 becomes more than the reference amount (ds<d1), and raises the pulse repetition rate when the slack amount LSs becomes less than the reference amount (ds>d1). Thus, the paper supply speed Vs is raised to add up the slack amount LSs to the reference amount, and is lowered to reduce the slack amount LSs down to the reference amount.

An ejection mechanism 63 is constituted of a transporting section 73, a bleaching device 74, a cutter 75 and a tray 76. The bleaching device 74 is the same device as the magenta optical fixing device 30, and projects near-ultraviolet rays of about 365 nm toward the recording material 10 for bleaching the white or blank portions thereof. The cutter 75 cuts the recording material 10 at margins between print areas into individual image pieces with reference to mark detection signals from a mark sensor 33. The transporting section 73 has the same construction as transporting sections 22, 23 and 24 of the printing stages 17 to 19. An ejection motor controller 77 is provided for controlling an ejection motor 79 to rotate a subsidiary feed roller pair 31 and a main feed roller pair 34 at a speed Vd that is variable depending upon the amount LSd of the slack 65. The slack amount LSd is detected as a distance signal "dd" by a slack sensor 78.

The ejection motor controller 77 has the same construction as the paper supply motor controller 69, and operates in the opposite direction to the paper supply motor controller 69, that is, in the same direction as magenta and cyan motor controllers 46 and 47.

Figure 12:
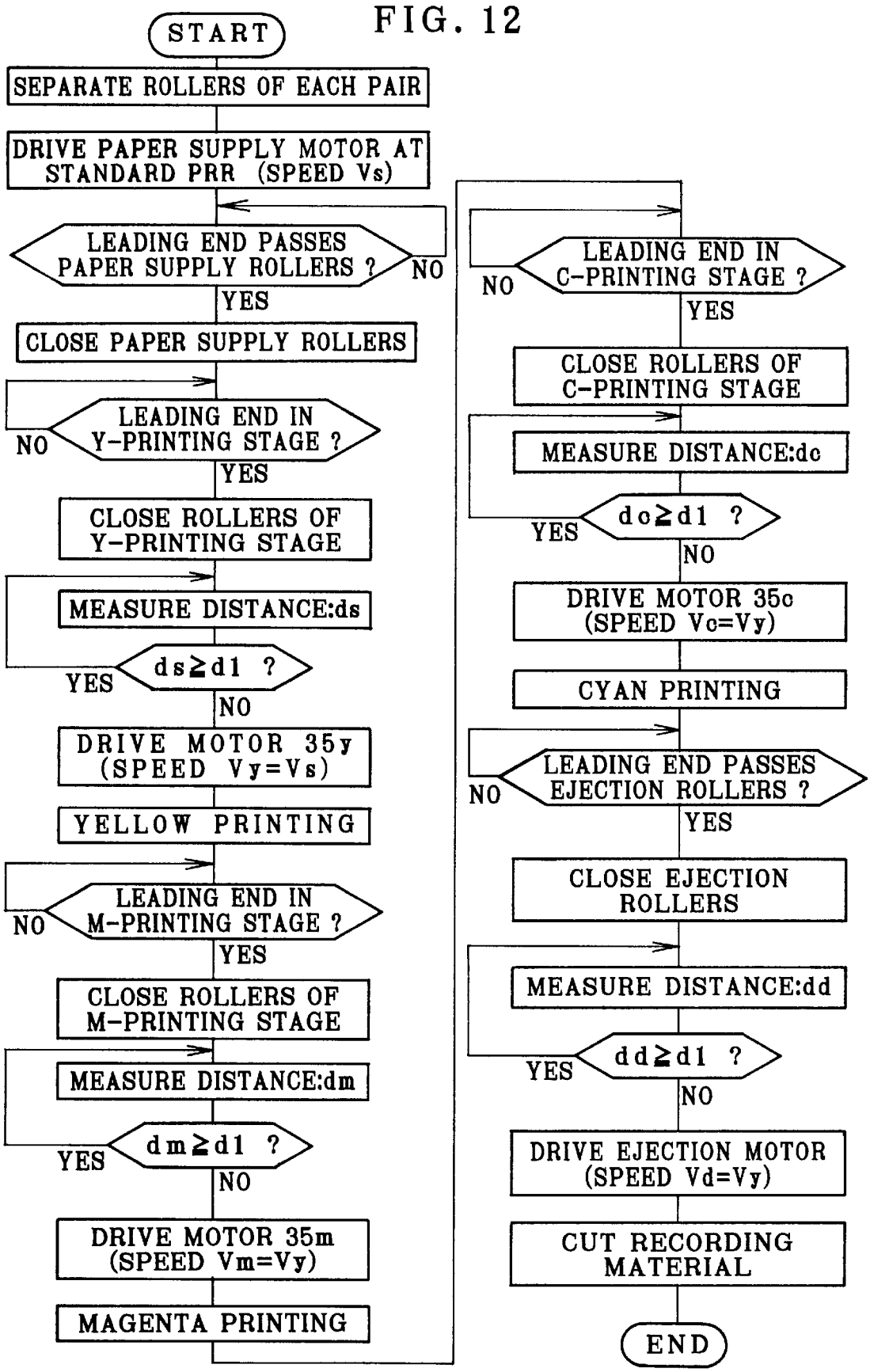
FIG. 12 is a flow chart illustrating a sequence of providing the slacks in the thermal printer of FIG. 10, according to the second method of the invention.

The slacks 64, 41, 42 and 65 are formed during an initial loading of the recording material 10 by postponing the start of feeding the recording material 10 from the time of nipping of the recording material 10 in each transporting section 22, 23, 24 or 73 till the slack 41, 42, 64 or 65 reaches the reference amount, as illustrated in FIG. 12, like the method of FIG. 5. In this method, all of the transporting speeds Vs, Vy, Vm, Vc and Vd are initially set to a standard value.

Figure 13:
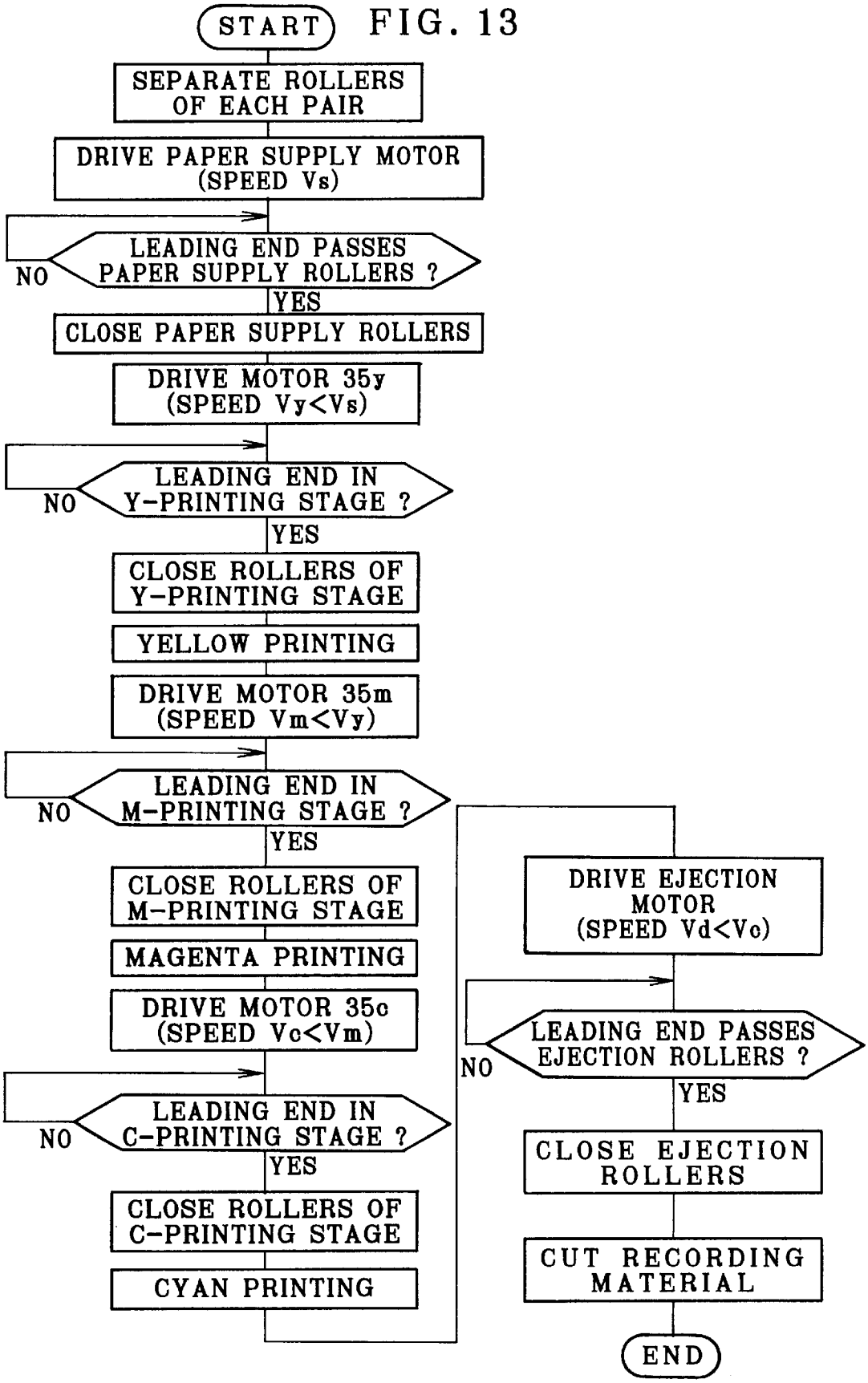
FIG. 13 is a flow chart illustrating a sequence of providing the slacks in the thermal printer of FIG. 10, according to the first method of the invention.
Figure 14:
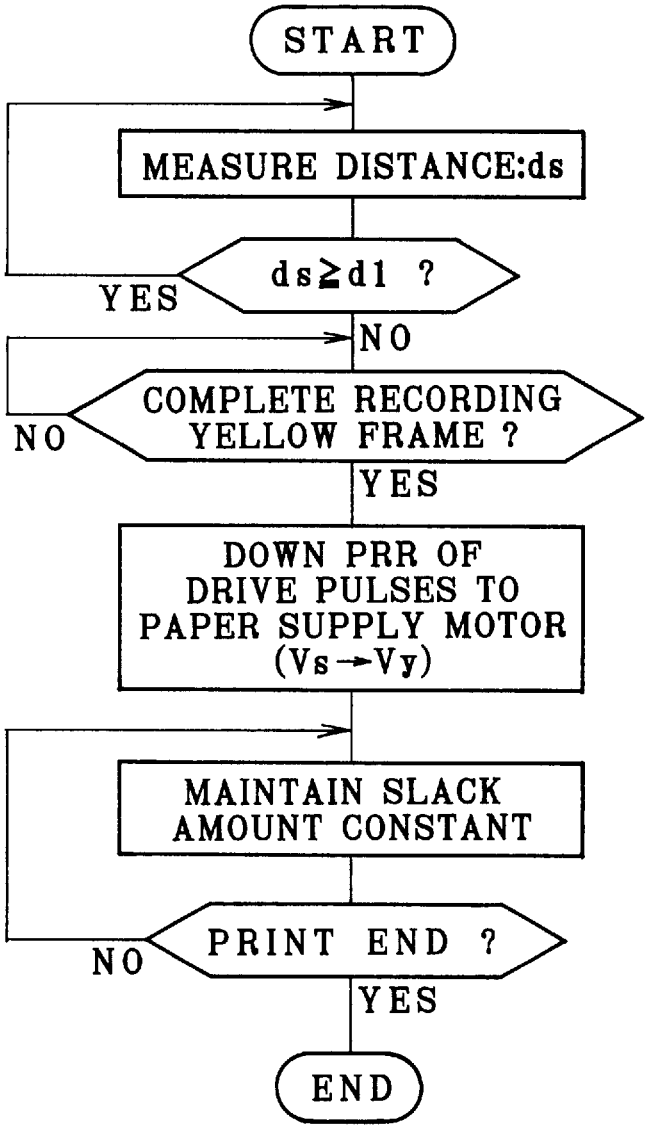
FIG. 14 is a flow chart illustrating an operation sequence of the paper supply motor controller to maintain the slack amount before the yellow thermal head constant following the sequence of FIG. 13.

Alternatively, it is possible to form the slacks 64, 41, 42 and 65 by setting the transporting speed of one printing stage higher than that of the next printing stage: Vs>Vy>Vm>Vc, as illustrated in FIG. 13, like the method of FIG. 3. The transporting speeds of two adjacent printing stages are thereafter equalized when the slack 64, 41, 42 or 65 formed therebetween reaches the reference amount, as illustrated for instance with respect to the slack 64 in FIG. 14. Also in this embodiment, the transporting speeds are changed after the completion of recording of one frame in the associated printing stage, so that the speed change may not affect the recording.

Figure 15A:
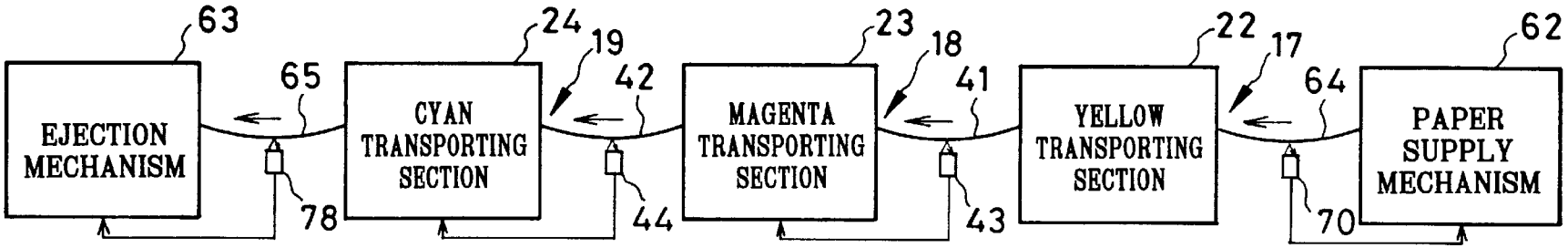
FIG. 15A is an explanatory block diagram illustrating the same construction as the embodiment of FIG. 10, wherein the yellow transporting section maintains a standard speed, while other transporting sections change transporting speeds in accordance with the slack amounts.
Figure 15B:
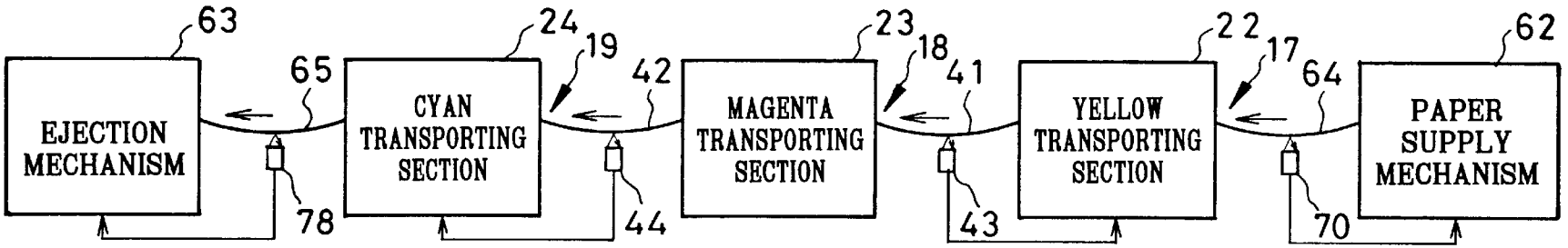
FIG. 15B is an explanatory block diagram illustrating another embodiment, wherein the magenta transporting section maintains a standard speed, while other transporting sections change transporting speeds in accordance with the slack amounts.
Figure 15C:
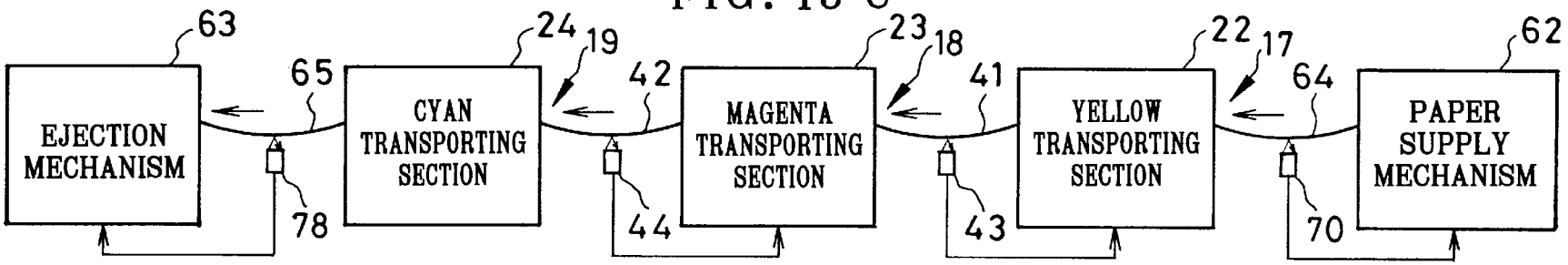
FIG. 15C is an explanatory block diagram illustrating a further embodiment, wherein the cyan transporting section maintains a standard speed, while other transporting sections change transporting speeds in accordance with the slack amounts.

In the embodiment of FIG. 10, the yellow transporting section 22 is driven always at a standard pulse repetition rate to fix the transporting speed Vy through the yellow printing stage 17 to a standard value. On the other hand, pulse repetition rate of the paper supply mechanism 62 and those of the transporting sections 23, 24 and 73 of the other printing stages 18 and 19 and the ejection mechanism 63 are changed in accordance with slack amounts detected by the slack sensors 70, 43, 44 and 78. Thereby, the transporting speeds Vs, Vm, Vc and Vd are changed relative to each other, so as to maintain the respective slack amounts in a range around the reference amount, as is diagrammatically shown in FIG. 15A. However, it is possible to keep the magenta transporting section 23 at the standard pulse repetition rate, while changing the pulse repetition rates of other transporting sections 22, 24 and 73 and of the paper supply mechanism 62, as is shown in FIG. 15B. It is also possible to fix the cyan transporting section 24 at the standard pulse repetition rate, as is shown in FIG. 15C. It is also possible to drive the paper supply motor 67 or the ejection motor 79 always at the standard pulse repetition rate, while driving the transporting sections 22 to 24 at variable pulse repetition rates to maintain the slack amounts constant, though it is not shown in the drawings.

For example, although the above described embodiments use pulse motors for transporting the recording material, it is possible to use another kind of speed controllable motors such as DC motors, and control the speeds by changing drive voltage. It is also possible to control the transporting speed based on results of comparison of the slack amount with an upper limit and a lower limit, instead of a single reference value.

In the initial loading, the pulse motors 35*y*, 35*m* and 35*c* start being driven in a sequential fashion after the detection of the leading edge of the recording material 10 in the associated printing stages. However, in the case of FIG. 3 or 13 where the initial speeds of the motors are different from one another, it is possible to start driving the motors at the same timing.

The present invention is applicable to a thermal printer where the platen rollers are driven to feed the recording material. The present invention is of course applicable to thermal ink transfer type and thermal wax transfer type color printers, and also ink-jet printers. The recording material may be transported in form of sheets having a limited length. It is possible to provide another printing stage for printing a specific color frame such as a black frame or a flesh color frame.

The subsidiary feed roller pairs 31 may be idling rollers, or may be omitted. In the latter case, the leading edge sensors 32 and the mark sensors 33 should be disposed behind the respective thermal heads 14 to 16.

It is possible to determine the leading edge of the recording material 10 based on the mark detection signal from the mark sensor 33 in each printing stage. Although the thermal heads 14 to 16 are kept in contact with the recording material 10 after the initial contact till the end of printing in the above embodiments, it is possible to separate each of the thermal heads 14 to 16 from the recording material 10 at the end of one print area, and press it again onto the recording material 10 at the start of the next print area. In that case, the consequent load changes would be absorbed by the slacks, and not affect the recording. It is possible to fix the platen rollers and move the thermal heads.

Thus, the present invention should not be limited to the above described embodiments but, on the contrary, various modification may be possible to those skilled in the art without departing from the scope of claims attached hereto.

What is claimed is:

1. A method of printing a full-color image on a recording material by a thermal printer while transporting the recording material through a transport path one time, the thermal printer having at least first to third printing stages arranged along the transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the method comprising the steps of:

providing slacks in the recording material between the first to third printing stages;

measuring respective amounts of the slacks;

transporting the recording material through the second printing stage at a constant speed; and controlling transporting speeds of the recording material through the first and third printing stages based on the amounts of the slacks, so as to maintain the amounts of the slacks constant during recording.

2. A method of printing a full-color image on a recording material by a thermal printer while transporting the recording material through a transport path one time, the thermal printer having a paper supply mechanism for supplying the recording material, at least first to third printing stages and an ejection mechanism for cutting and ejecting the recording material which are arranged along the transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the method comprising the steps of:

providing slacks in the recording material between the paper supply mechanism and the first printing stage, between the first to third printing stages, and between the third printing stage and the ejection mechanism;

transporting the recording material through one of the paper supply mechanism, the first to third printing stages and the election mechanism at a first speed;

measuring respective amount of the slacks; and controlling transporting speeds of the recording material through other of the paper supply mechanism, the first to third printing stages and the ejection mechanism based on the amounts of the slacks, so as to maintain the amounts of the slacks in a predetermined range.

3. A method of printing a full-color image on a recording material by a thermal printer while transporting the recording material through at least first to third printing stages one time, which are arranged along a transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the method comprising the steps of:

A. transporting a leading edge of the recording material from the first printing stage to the second printing stage;

B. stopping the leading edge in the second printing stage while continuing to transport the recording material through the second printing stage until a second slack of a first amount is formed between the first printing stage and the second printing stage;

C. transporting the leading edge of the recording material from the second printing stage to the third printing stage;

D. stopping the leading edge in the third printing stage while continuing to transport the recording material through the second printing stage until a second slack of a second amount is formed between the second printing stage and the third printing stage; and E. maintaining the first and second amounts of the first and second slacks, respectively, within a fixed range.

4. The method according to claim 3, wherein the first and second amounts of the first and second slacks, respectively, are measured by first and second slack sensors, respectively, each of which measures a distance from the respective slack sensors to a peak of the first and second slacks, respectively.

5. The method according to claim 4, wherein step E further comprises the steps of:

transporting the recording material through the second printing stage at a constant speed;

controlling transporting speeds through the first printing stage in accordance with the amount of the first slack; and controlling transporting speeds through the third printing stage in accordance with the amount of the second slack.

6. A method of printing a full-color image on a recording material by a thermal printer while transporting the recording material through a transport path one time, the thermal printer having at least first to third printing stages arranged along the transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the method comprising the steps of:

A. transporting a leading edge of the recording material through the second printing stage at a lower speed than a transporting speed for the leading edge through the first printing stage, to provide a first slack in the recording material between the first and the second printing stages;

B. transporting the leading edge of the recording material through the third printing stage at a lower speed than the transporting speed for the leading edge through the second printing stage, to provide a second slack in the recording material between the second and the third printing stages;

C. measuring respective amounts of the first and second slacks;

D. resetting the transporting speeds through the first to third printing stages to be equal to each other after the slacks reach a predetermined amount; and E. maintaining the first and second slacks in a range around the predetermined amount while the thermal heads execute recording.

7. The method according to claim 6, wherein the transporting speed through the first printing stage is fixed to a constant value, and the transporting speeds through the second and third printing stages are raised to be equal to the constant value in step D.

8. The method according to claim 7, wherein a plurality of full-color images are printed in succession along the recording material, and wherein the transporting speeds for the leading edge through the first to third printing stages are defined such that the first or the second slack reaches the predetermined amount when the thermal head of the second or the third printing stage completes recording one color frame, respectively, so that the transporting speed through each of the second and third printing stages is changed in a period when a margin between adjacent print areas moves under the thermal head of the second and third printing stages, respectively.

9. The method according to claim 6, wherein the transporting speeds for the leading edge through the first to third printing stages are defined such that the first or the second slack reaches the predetermined amount while a leading margin from the leading edge to a print start position of the recording material is transported under the thermal head of the second or the third printing stage, respectively.

10. The method according to claim 6, wherein step E further comprises the steps of:

fixing the transporting speed of the recording material through the second printing stage at a constant value;

controlling the transporting speed through the first printing stage in accordance with the amount of the first slack; and controlling the transporting speed through the third printing stage in accordance with the amount of the second slack.

11. A color thermal printer for printing a full-color image on a recording material while transporting the recording material through a transport path one time, the thermal printer having at least first to third printing stages arranged along the transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the color thermal printer comprising:

first to third transporting devices for transporting the recording material through the first to third printing stages, respectively;

a first slack sensor for measuring an amount of first slack formed between the first and second transport devices;

a second slack sensor for measuring an amount of second slack formed between the second and third transport devices; and control means for controlling the first transporting device in accordance with an output from the first slack sensor, and controlling the third transporting device in accordance with an output from the second slack sensor.

12. The color thermal printer according to claim 11, wherein the first and second slack sensors are micro-displacement gages, each of the micro-displacement gages having a light projector and a light receptor to measure a distance from the micro-displacement gages to a peak of the first or the second slack as a value representative of the amount of the first or the second slack, respectively.

13. A color thermal printer for printing a full-color image on a recording material while transporting the recording material through a transport path one time, the thermal printer having at least first to third printing stages arranged along the transport path in this order from upstream, each of the printing stages for recording a particular color frame of the full-color image and comprising a thermal head and a platen which are disposed across the transport path to be movable relative to each other, the recording material being nipped between the thermal head and the platen in each of the printing stages prior to starting recording the particular color frame, the color thermal printer comprising:

first to third transporting devices for transporting the recording material through the first to third printing stages, respectively;

an ejection mechanism which is disposed in a downstreammost position of the transport path for cutting and ejecting the recording material;

a fourth transporting device for transporting the recording material through the ejection mechanism; and control means for controlling the first to fourth transporting devices so as to provide the recording material with first and second slacks between the first to third printing stages, and a third slack before the ejection mechanism.

14. The color thermal printer according to claim 13, further comprising a paper supply mechanism for supplying the recording material toward the first printing stage, wherein the control means controls speed of supplying the recording material so as to provide the recording material with a slack between the paper supply mechanism and the first printing stage, and maintain the amount of slack in a fixed range.

* * * * *